US005791532A

United States Patent [19]

Roehl et al.

[11] Patent Number: 5,791,532

[45] Date of Patent: Aug. 11, 1998

[54] PROCESS FOR REVERSING AND END-SHAPING INFLATABLE BODIES

[75] Inventors: Ernst Roehl, Hildesheim; Klaus Lissewski, Seevetal; Rolf Peters, Buxtehude; Joachim Pollmann, Neu Wulmstorf, all of Germany

[73] Assignee: Phoenix Airbag GmbH & Co. KG, Hildesheim, Germany

[21] Appl. No.: 809,279

[22] PCT Filed: Nov. 23, 1995

[86] PCT No.: PCT/DE95/01638

§ 371 Date: Mar. 11, 1997

§ 102(e) Date: Mar. 11, 1997

[87] PCT Pub. No.: WO96/17993

PCT Pub. Date: Jun. 13, 1996

[30] Foreign Application Priority Data

Dec. 5, 1994 [DE] Germany ..... 44 43 724.2

[51] Int. Cl.[6] ..... A41H 43/02; B60R 21/16

[52] U.S. Cl. ..... 223/39; 280/728.1

[58] Field of Search ..... 28/217; 26/29 R; 223/39, 40, 41, 42, 43; 280/728.1

[56] References Cited

U.S. PATENT DOCUMENTS 4,392,596 7/1983 Painter ..... 223/43
5,114,180 5/1992 Kami et al. ..... 280/743
5,134,947 8/1992 Price et al. ..... 112/63

FOREIGN PATENT DOCUMENTS 1 778 607 10/1958 Germany .
25 57 155 7/1976 Germany .
34 36 252 4/1986 Germany .
3 161568 7/1991 Japan .

*Primary Examiner*—Scott W. Houtteman
*Attorney, Agent, or Firm*—Collard & Roe, P.C.

[57] ABSTRACT

A process is disclosed for reversing and end shaping inflatable bodies made of coated or uncoated fabric, in particular airbags, by using a device having a reversing pipe that receives the body or airbag; a die provided with a compressed air connection and an inflating hole and which pushes the body or airbag completely into the reversing pipe when it moves downwards and at the same time reverses the body or airbag; a sealing element that makes the top edge of the reversing pipe pressure-tight once the die has finished moving; and a collecting device in the area of the reversing pipe end in which the body or airbag is end shaped after being pushed out of the reversing pipe by a compressed air blast blown through the die so as to inflate and deploy the reversed airbag.

28 Claims, 4 Drawing Sheets

PROCESS FOR REVERSING AND END-SHAPING INFLATABLE BODIES

BACKGROUND OF THE INVENTION

1. Field of the Invention

The invention relates to a process for reversing and finally shaping inflatable bodies consisting of fabric(s) with or without coating, in particular airbags, using a suitable device.

2. The Prior Art

Various reversing devices for slackingly bending fabric parts are known from the textile-processing industry (DE-B-25 57 155; DE-U-17 78 607). Such devices, however, are not usable for reversing and finally shaping airbags of any construction because of the materials used and the pre-specified geometric shape. The airbag is a large-volume, textile structure with small-sized openings; this condition makes the reversing process considerably more difficult. During reversing, the inside of the body or airbag is passed through an opening in the body or airbag in a way such that it subsequently forms the outside, whereas the previous outside is then the inside.

SUMMARY OF THE INVENTION

Therefore, the object of the present invention is to make available an economical process for the reversing of inflatable bodies, in particular of airbags, by means of a device that is particularly suitable for such a process.

Completing the reversing process, final shaping of the body or airbag is to be carried out with the same device as well. In this connection, the fabric must not be expanded excessively. Furthermore, no folds must remain afterwards.

This object of the process is achieved with the use of a device comprising

- a reversing pipe receiving the body or airbag;
- a die provided with a compressed-air connection and with a blow-out hole, whereby the downwardly driving die pushes the body or airbag completely into the reversing pipe while simultaneously reversing the body or airbag;
- a sealing element sealing the top edge of the reversing pipe airtight after the die has completed its movement; as as well as
- a collecting device, in which the body or airbag is finally shaped after it has been driven out of the reversing die by a blast of compressed air through the die so as to inflate and unfold it in the reversed condition.

Usefully, a die satisfying the following criteria is used:

- The compressed-air connection is located in the top part, particularly directly on the circumference of the die;
- A reversing head is arranged in the lower part, namely directly at the end of the die, said head being fitted with one or a plurality of blow-out openings, whereby the compressed-air connection is connected with the one or more blow-out opening(s) of the reversing head via an air duct contained in the die. Furthermore, when the reversing pipe is in the closed condition, the reversing head projects into the collecting device;
- In the upper part, the die has a sealing element, in particular a sealing plate made of metal and/or elastomeric material.

The following design parameters usefully apply with respect to the reversing pipe:

- On its top edge, the reversing pipe is fitted with a sliding, ball or roller ring, such a ring being designed with respect to shape, material and surface in such a way that only minimal frictional forces are directed against the reversing process;
- In the zone of transition between the end of the reversing pipe and the collecting device, the reversing pipe is designed in a way such that the final shaping process of the body or airbag is met by only minor resistance.

Furthermore, it is advantageous with respect to the interaction between the die and the reversing pipe if said parts of the device each are connected in a fixed way with a horizontally extending holding arm, whereby each holding arm in turn is in contact with a guide rail extending parallel with the die and the reversing pipe, namely with vertical displaceability of the holding arms. The holding arm is, in this connection, usefully arranged above the sealing element or sealing plate, i.e., the sealing element or sealing plate is here an integrated component of the holding arm. It is particularly advantageous in connection with this overall arrangement principle if the reversing pipe is, as the body or airbag is being pushed in, driven downwardly by means of a drive at half the speed of the die.

Furthermore, it is useful if a collecting device is used, such device limiting the discharge of the body or airbag downwardly by means of a horizontal bottom for the purpose of obtaining as flat a final shaping as possible in the radial direction. Also, it is an advantage if the collecting device is alternatively designed in the form of a transporting device for removing the reversed and finally shaped body or airbag.

Finally, it is advantageous if additional devices are available for adjusting with their help the time, pressure and volume of the stream of blasted compressed air required for the final shaping of the body or airbag.

BRIEF DESCRIPTION OF THE DRAWINGS

Now, the invention is explained on an exemplified embodiment by reference to the schematic drawings, in which.

Figure 1A:
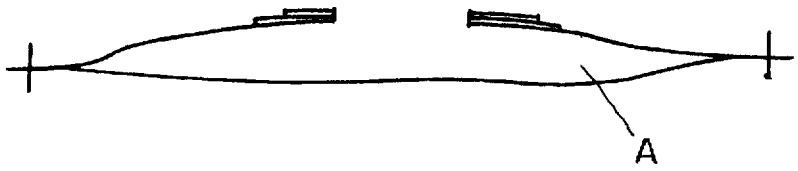
FIG. 1A shows a sectional representation of an airbag immediately following its manufacture.

The following list of reference symbols is applicable in connection with the above figures:

A Airbag (immediately after its manufacture)
B Airbag (reversed, but not yet finally shaped)
C Airbag (reversed and finally shaped)
1 Guide rail
1' Holding arm for the die
1" Holding arm for the reversing pipe 2 Reversing pipe
2' Top edge (opening) of the reversing pipe
2" Transition zone between end of the reversing pipe and the collecting device
3 Collecting device
3' Bottom of collecting device
4 Die
4' Head of die
4" End of die
5 Compressed-air connection
5' Air duct
5" Blow-out openings
6 Sealing element (sealing plate)
7 Sliding, ball or roller ring
8 Reversing head

DETAILED DESCRIPTION OF PREFERRED EMBODIMENTS

Figure 3:
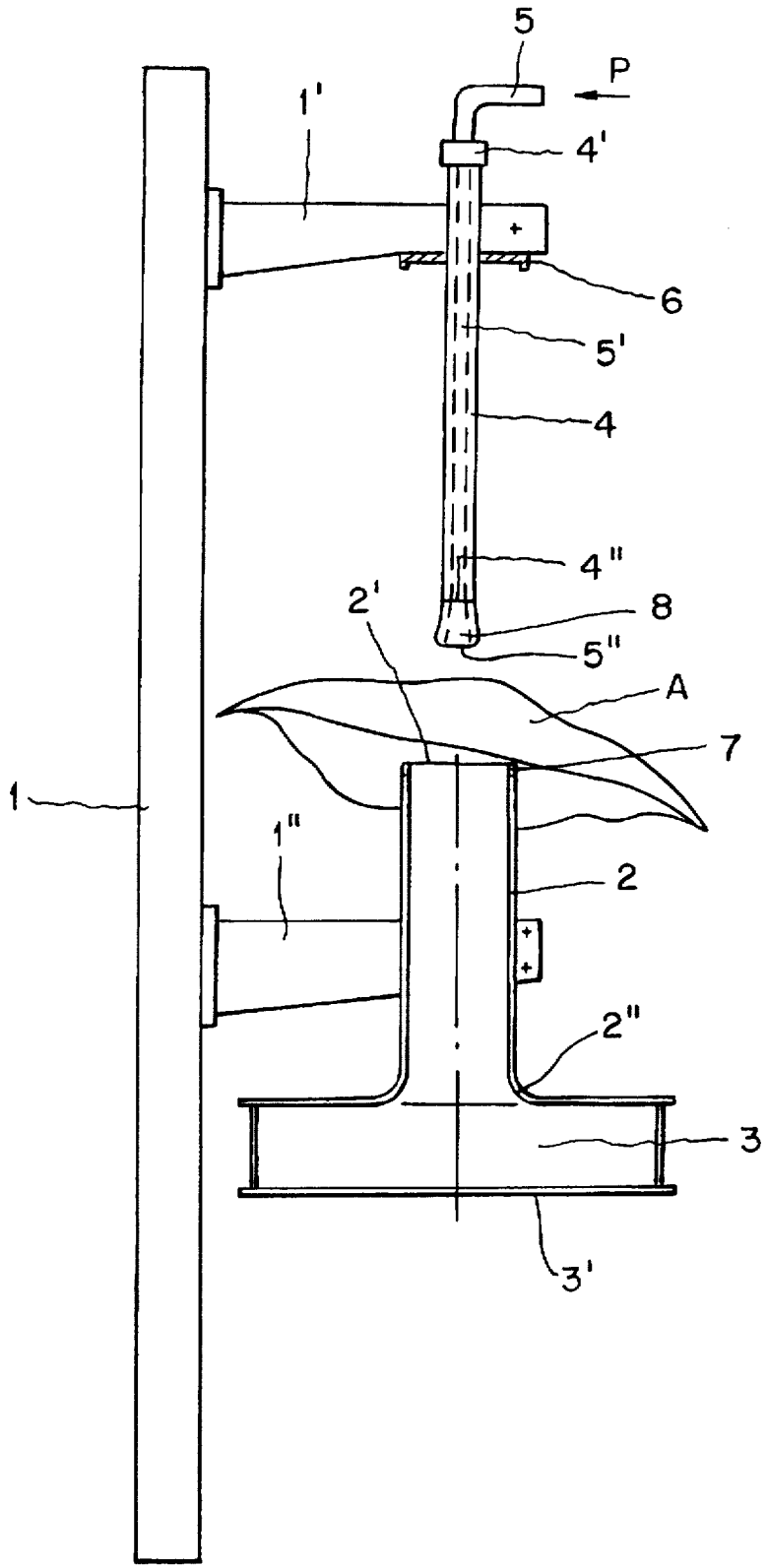
FIG. 3 shows a device with the die extended.

According to FIG. 3, the device comprises a guide rail 1, which is fitted with two horizontally extending holding arms 1' and 1", whereby said holding arms are vertically displaceable within the guide rail by means of a drive.

The die 4 is fitted with a sealing element 6 (here a sealing plate). Now, directly above said sealing plate, the die is connected with the holding arm 1' in a fixed way. A compressed-air connection 5 is located at the head 4' of the die, whereas the die end 4" is fitted with a reversing head 8, the latter in turn being provided with one or a plurality of blow-out opening(s) 5", whereby the compressed-air connection is connected with the blow-out opening(s) of the reversing head via an air duct 5' contained in the die.

Figure 2A:
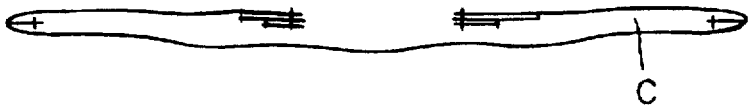
FIG. 2A shows a sectional representation of a reversed and finally shaped airbag.
Figure 2B:
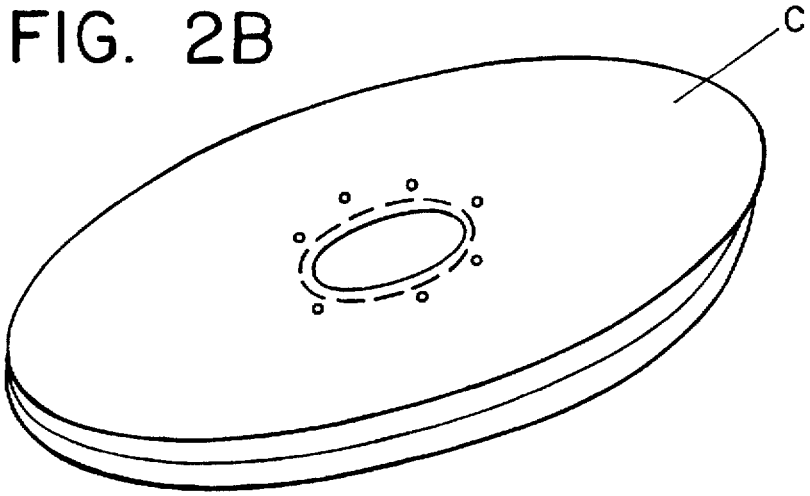
FIG. 2B shows a three-dimensional representation of an airbag according to FIG. 2A.

The reversing pipe 2 itself is connected in a fixed way with the holding arm 1" in its center zone. At its top edge 2', the reversing pipe 2 is fitted with a sliding, ball or roller ring 7, such a ring being designed with respect to its shape, material and surface in a way such that only low frictional forces are directed against the reversing process. Furthermore, in the transition zone 2" between the end of the reversing pipe and the collecting device 3, the reversing pipe is designed in a way such that the final shaping process of the airbag B (FIG. 6) into the condition C (FIGS. 2A, 2B, 7) is opposed by only minor resistance. The collecting device itself is downwardly limited by means of a horizontal bottom 3' for the purpose of obtaining as flat a final shaping of the airbag C as possible in the radial direction.

Figure 1B:
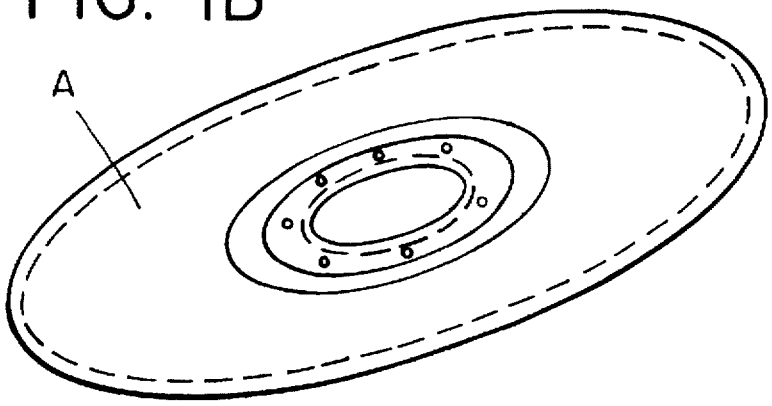
FIG. 1B shows a three-dimensional representation of the airbag according to FIG. 1A.
Figure 4:
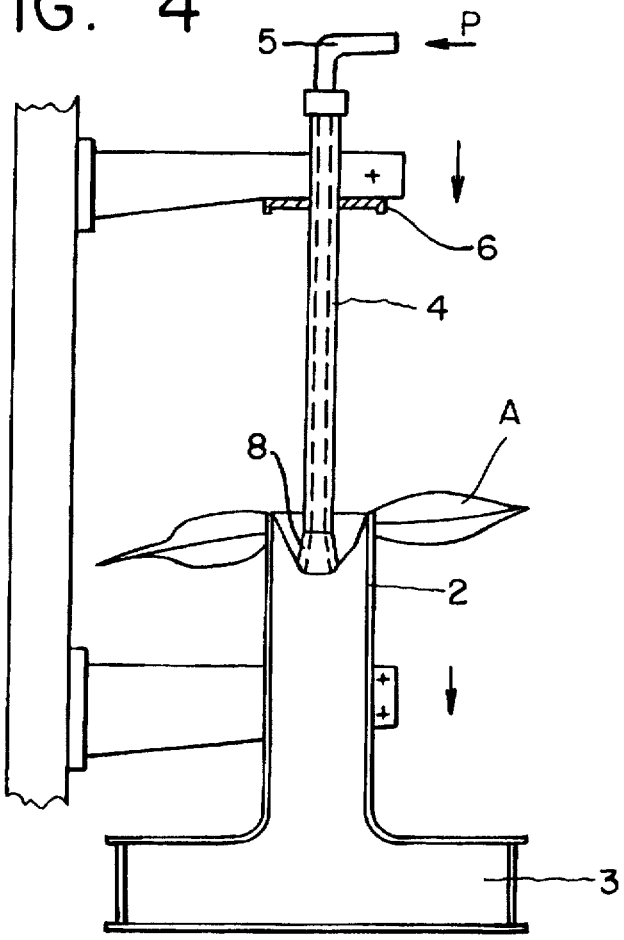
FIG. 4 shows a device in connection with which the die penetrates the reversing pipe while the airbag is simultaneously received in the reversing pipe.

Now, the airbag A (FIGS. 1A, 1B), with the opening placed over the reversing pipe 2, is pushed into the reversing pipe 2 by the downwardly driving die 4 with the reversing head 8 (FIG. 4). In this process, the reversing pipe is moving downwardly (in the direction of the arrow according to FIG. 4) by means of a drive with half the speed of the die. Drawing of the airbag into the reversing pipe is facilitated in this way and the formation of sharp folds is prevented. This is supported by the sliding, ball, or roller ring mounted on the top edge of the reversing pipe, such ring being optimized with respect to shape and material.

Figure 5:
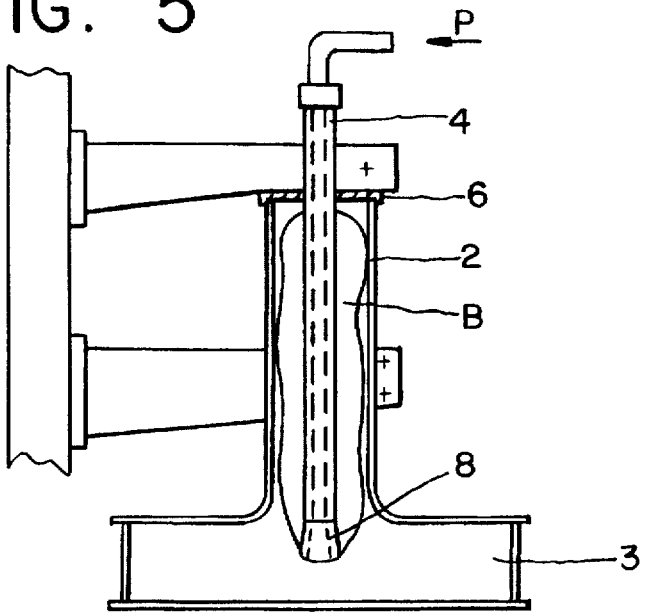
FIG. 5 shows a device with the reversing pipe in the closed condition.

According to FIG. 5, the die 4 moves relative to the reversing pipe 2 until the entire airbag B is present in the reversing pipe in the already reversed condition. At said final point, the sealing plate 6 seals the reversing pipe against the top side. In said closed condition, the reversing head 8 projects into the collecting device 3.

Figure 6:
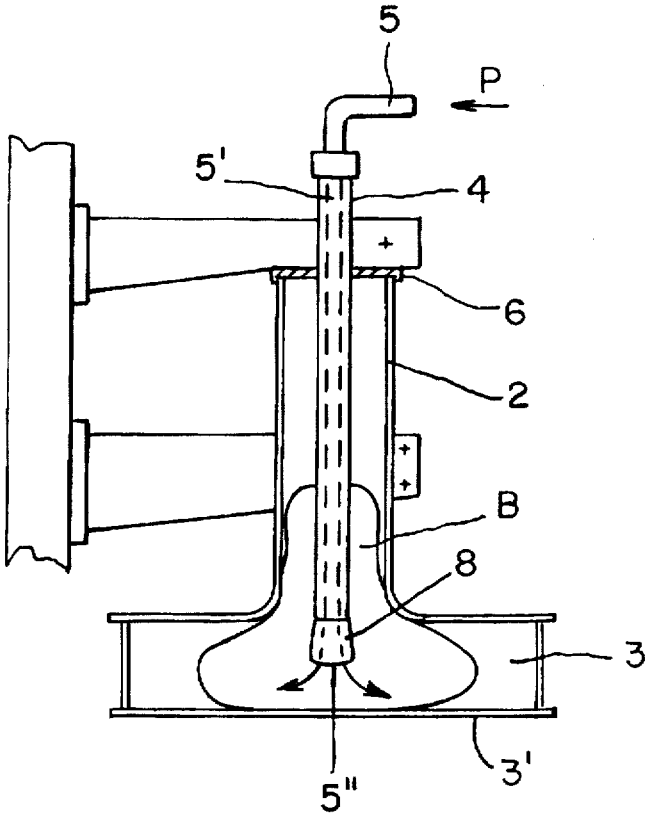
FIG. 6 shows a device with the reversing pipe in the closed condition as the reversed airbag is being driven out and simultaneous impacting the collecting device.

Now, according to FIG. 6, a strong blast of air (via the compressed-air connection 5) through the air duct 5' of the die 4 and through the blow-out openings 5" of the reversing head 8 drives the airbag B out of the reversing pipe. When the airbag then impacts the horizontal bottom 3' of the collecting device 3, inflating and unfolding of the airbag takes place.

Figure 7:
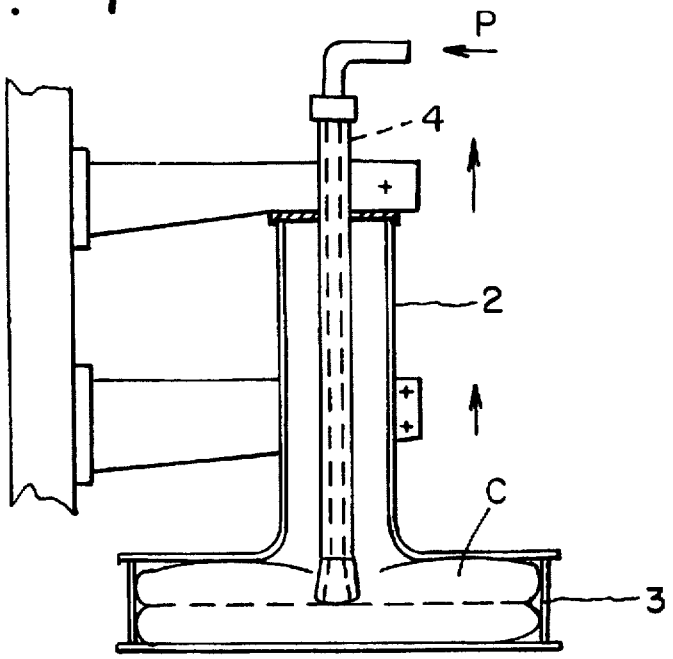
FIG. 7 shows a device with the airbag in the reversed and finally shaped condition.

Now, FIG. 7 shows the reversed and finally shaped airbag C, which is then removed from the collecting device 3. The die 4 now moved upwardly (in the direction of the arrow) at twice the speed of the reversing pipe 2, namely as the reversing pipe opens (starting condition according to FIG. 3).

We claim:

1. Process for reversing and finally shaping an inflatable body made of a fabric with or without a coating, for an airbag, comprising the steps of:

providing a reversing pipe for receiving a body or airbag;

providing a die with a compressed-air connection and a blow-out opening, and downwardly driving said die to completely push the body or airbag into the reversing pipe as the body or airbag is simultaneously being reversed;

providing a sealing element for sealing a top edge of the reversing pipe airtight after a movement of the die has been completed;

providing a collecting device within a zone of an end of the reversing pipe, and finally shaping the body or airbag in said zone after it has been driven by means of a blast of compressed air through the die from the reversing pipe in a reversed condition while inflating and unfolding.

2. Process according to claim 1, comprising using said die and disposing the compressed-air connection in a top part thereof and directly on a head of the die.

3. Process according to claim 1, comprising using said die which, in a lower part, is provided with a reversing head directly on a die end.

4. Process according to claim 3, comprising using said reversing head which is fitted with at least one blow-out opening and connecting the compressed-air connection with the blow-out opening of the reversing head via an air duct contained in the die.

5. Process according to claim 1, comprising using said die which, in a top part has said sealing element, or a sealing plate made of metal or elastomeric material.

6. Process according to claim 1, comprising using said die and said reversing pipe, each of which is connected in a fixed way with a horizontally extending holding arm; and having each holding arm in turn in contact with a guide rail and said guide rail extending parallel with the die and the reversing pipe, and having vertical displaceability of each holding arm within the guide rail.

7. Process according to claim 1, comprising using said die having a holding arm arranged directly above the sealing element.

8. Process according to claim 1, comprising moving the reversing pipe, as the body or airbag is being pushed into it, downwardly by means of a drive moving at half the speed of the die.

9. Process according to claim 1, comprising using said reversing pipe which, at said top edge, is fitted with a sliding ball or roller ring, the shape, material and surface of said ring being said that only minimal frictional forces are directed against the reversing process.

10. Process according to claim 1, comprising using said reversing pipe which, in a transition zone between the end of the reversing pipe and the collecting device, has only low resistance to opposing the finally shaping of the body or airbag.

11. Process according to claim 1, comprising using said collecting device which limits the discharge of the body or airbag downwardly by means of a horizontal bottom for the purpose of obtaining as flat a final shape as possible in a radial direction.

12. Process according to claim 1, comprising using said collecting device which is a transporting device for removing the reversed and finally shaped body or airbag.

13. Process according to claim 1, comprising using additional devices for adjusting with their help the time, pressure and flow by volume of the blast of compressed air required for the final shaping of the body or airbag.

14. Process according to claim 3, comprising using said reversing head which, in a closed condition of the reversing pipe, projects into the collecting device.

15. Device for reversing and finally shaping an inflatable body made of a fabric with or without a coating, for an airbag, comprising:

a reversing pipe for receiving the body or airbag;

a die provided with a compressed-air connection and a blow-out opening, whereby the downwardly driving die completely pushes the body or airbag into the reversing pipe as the body or airbag is simultaneously being reversed;

a sealing element for sealing a top edge of the reversing pipe airtight after the movement of the die has been completed;

a collecting device within a zone of an end of the reversing pipe, in which the body or airbag is finally shaped after it has been driven by means of a blast of compressed air through the die from the reversing pipe in a reversed condition while inflating and unfolding.

16. Device according to claim 15, wherein said die is used in connection with which the compressed-air connection which is disposed in a top part thereof directly on a head of the die.

17. Device according to claim 15, wherein said die which, in a lower part, is provided with a reversing head directly on an end of the die.

18. Device according to claim 17, wherein said reversing head is fitted with at least one blow-out opening, and there is a means for connecting the compressed-air connection with the blow-out opening of the reversing head via an air duct contained in the die.

19. Device according to claim 15, wherein said die which, in a top part has a sealing element made of metal or elastomeric material.

20. Device according to claim 15, wherein said die and said reversing pipe, each of which is connected in a fixed way with a horizontally extending holding arm;

each holding arm is in turn in contact with a guide rail and said guide rail extending parallel with the die and the reversing pipe; and each holding arm having vertical displaceability within the guide rail.

21. Device according to claim 19, wherein said die has a holding arm arranged directly above the sealing element.

22. Device according to claim 15, wherein said reversing pipe, as the body or airbag is being pushed into it, is moved downwardly by means of a drive moving at half the speed of the die.

23. Device according to claim 15, wherein said reversing pipe which, at a top edge, is fitted with a sliding ball or roller ring, the shape, material and surface of said ring being such that only minimal frictional forces are directed against the reversing process.

24. Device according to claim 15, wherein said reversing pipe which, in a transition zone between an end of the reversing pipe and the collecting device, has only low resistance to opposing a final shaping of the body or airbag.

25. Device according to claim 15, wherein said collecting device limits the discharge of the body or airbag downwardly by means of a horizontal bottom for the purpose of obtaining as flat a final shape as possible in a radial direction.

26. Device according to claim 15, wherein said collecting device is a transporting device for removing the reversed and finally shaped body or airbag.

27. Device according to claim 15, further comprising additional devices for adjusting with their help the time, pressure and flow by volume of the blast of compressed air required for a final shaping of the body or airbag.

28. Device according to claim 17, wherein said reversing head in a closed condition of the reversing pipe, projects into the collecting device.

* * * * *